US010612283B2

(12) United States Patent
Corbett

(10) Patent No.: US 10,612,283 B2
(45) Date of Patent: Apr. 7, 2020

(54) PORTABLE DOOR LOCK

(71) Applicant: William R. Corbett, Austin, TX (US)

(72) Inventor: William R. Corbett, Austin, TX (US)

( * ) Notice: Subject to any disclaimer, the term of this patent is extended or adjusted under 35 U.S.C. 154(b) by 327 days.

(21) Appl. No.: 15/666,876

(22) Filed: Aug. 2, 2017

(65) Prior Publication Data

US 2017/0328101 A1 Nov. 16, 2017

(51) Int. Cl.
*E05C 19/18* (2006.01)

(52) U.S. Cl.
CPC ..... *E05C 19/182* (2013.01)

(58) Field of Classification Search
CPC ..... E05C 19/182; E05C 17/54; E05C 19/003; E05C 65/0894; E05C 67/00; E05C 19/18; E05C 19/184; E05C 19/188; E05C 19/186
USPC ..... 292/256.73
See application file for complete search history.

(56) References Cited

U.S. PATENT DOCUMENTS

| | | | | | |
|---|---|---|---|---|---|
| 208,176 | A | | 9/1878 | Ingalls | |
| 540,423 | A | | 6/1895 | Chivill | |
| 587,496 | A | | 8/1897 | Stone | |
| 592,854 | A | | 11/1897 | Whipple | |
| 684,000 | A | | 10/1901 | Shore | |
| 880,108 | A | | 2/1908 | Smith | |
| 1,064,449 | A | | 6/1913 | Dansey | |
| 1,171,266 | A | | 2/1916 | Simmons | |
| 1,255,996 | A | | 2/1918 | Ehrhardt | |
| 1,293,414 | A | | 2/1919 | Grimeck | |
| 1,434,411 | A | | 11/1922 | Silverstein | |
| 1,477,731 | A | * | 12/1923 | Ulrich | E05C 19/182 292/294 |
| 1,671,454 | A | | 5/1928 | Stoutenburgh | |
| 3,429,151 | A | | 2/1969 | Weingart | |
| 4,290,635 | A | * | 9/1981 | McKenzie | E05C 19/182 292/290 |
| 4,763,938 | A | * | 8/1988 | Schlanger | E05C 19/182 292/290 |
| 5,135,272 | A | * | 8/1992 | Centofante | E05C 19/182 292/293 |
| 2010/0026017 | A1 | | 2/2010 | Ramos, III | |

* cited by examiner

*Primary Examiner* — Nathan Cumar

(57) ABSTRACT

A portable door lock for use with a door hingedly mounted in a doorway formed of a door jamb and a locking recess wherein the door lock can be formed of first and second rectilinear U-shaped members formed of flat strips of metal.

5 Claims, 5 Drawing Sheets

PORTABLE DOOR LOCK

FIELD OF THE INVENTION

The present invention pertains to door locks and, more particularly, to portable door locks that can be transported by an individual and used when the door locks provided in buildings are not substantial, such as in hotels, office and commercial buildings, apartments and personal homes, thereby increasing the personal security for those using the portable door lock.

BRIEF DISCUSSION OF THE RELATED ART

Security of doors has in the past utilized locking mechanisms integrated with the doors and/or a door jamb or frame such that security of the doors is questionable. U.S. Pat. No. 4,763,938 to Schianger and U.S. Pat. No. 5,135,272 to Centofante are representative of prior art arrangements for providing portable door locks or securing devices for use by, for example, travelers staying in temporary lodgings or quarters. The prior art arrangements have had the disadvantages of being overly cumbersome to install and having not been designed for simplified use in securing a door to a door jamb or frame). Additionally, the prior art arrangements have the disadvantage of not permitting universal use with doors and door jambs of varying configurations being bulky so as to not be easily carried.

SUMMARY OF THE INVENTION

The present invention relates to a portable door lock overcoming the disadvantages of the prior art and incorporating only a minimum of parts. The portable door lock of the present n renders a door impenetrable except by breaking through the interior portion of the door itself. The portable door lock of the present invention can be fixed to a door jamb quickly and dramatically increases the security of the door by protecting against attempts to break through the door jamb and the door knob areas.

The portable door lock of the present invention can be used to recreate a safe room for potential victims of domestic violence as well being useful to better safeguard entrance into motel rooms, late night work places and the like. The portable door lock of the present invention is strong, yet light in weight, and sufficiently small to be carried in a handbag or a briefcase. Once the portable door lock of the present invention is correctly in place, the portable door lock renders existing door locks useless and prevents entry by others having keys or cards to open the door.

A primary aspect of the present invention is the design of cooperating, first and second U-shaped members formed of flat strips of metal to present a lightweight, strong arrangement for locking a door relative to a door jamb.

In another aspect, the portable door lock of the present invention can be simply adjusted, after installation, to permit, the door to be opened and closed and thereafter returns to the position preventing opening of, the door. The simple adjustment also facilitates easy and quick egress in the event of an emergency.

The portable door lock of the present invention is intended for use with a door hingedly mounted in a doorway formed of a door jamb or frame with a locking recess therein. The portable door lock is made of first and second members formed of flat strips of metal bent to have rectilinear U-shapes with a first member having pair of opposing legs of equal length extending from ends of a central portion, with the central portion having a length greater than the combined length of the opposing legs and having a hole, therethrough at a position between the opposing legs. The opposing legs each have an inwardly extending foot extending toward the opposing foot. The second member has a connecting portion between opposing first and second ends with a locking tab extending transversely from the first end and a threaded adjustment shaft disposed at the second end and extending through the hole in the central portion of the first member. A threaded nut engages the threaded adjustment shaft such that rotation of the threaded nut moves the first member relative to the second member to cause the feet of the opposing legs of the first member to engage structure of the door and for the door jamb simultaneously.

Other advantages and aspects of the present invention will become apparent from the following description of the portable door lock taken in conjunction with the accompanying drawings wherein like parts in each of the several figures are identified by the same reference character.

DETAILED DESCRIPTION OF THE INVENTION

Figure 1:
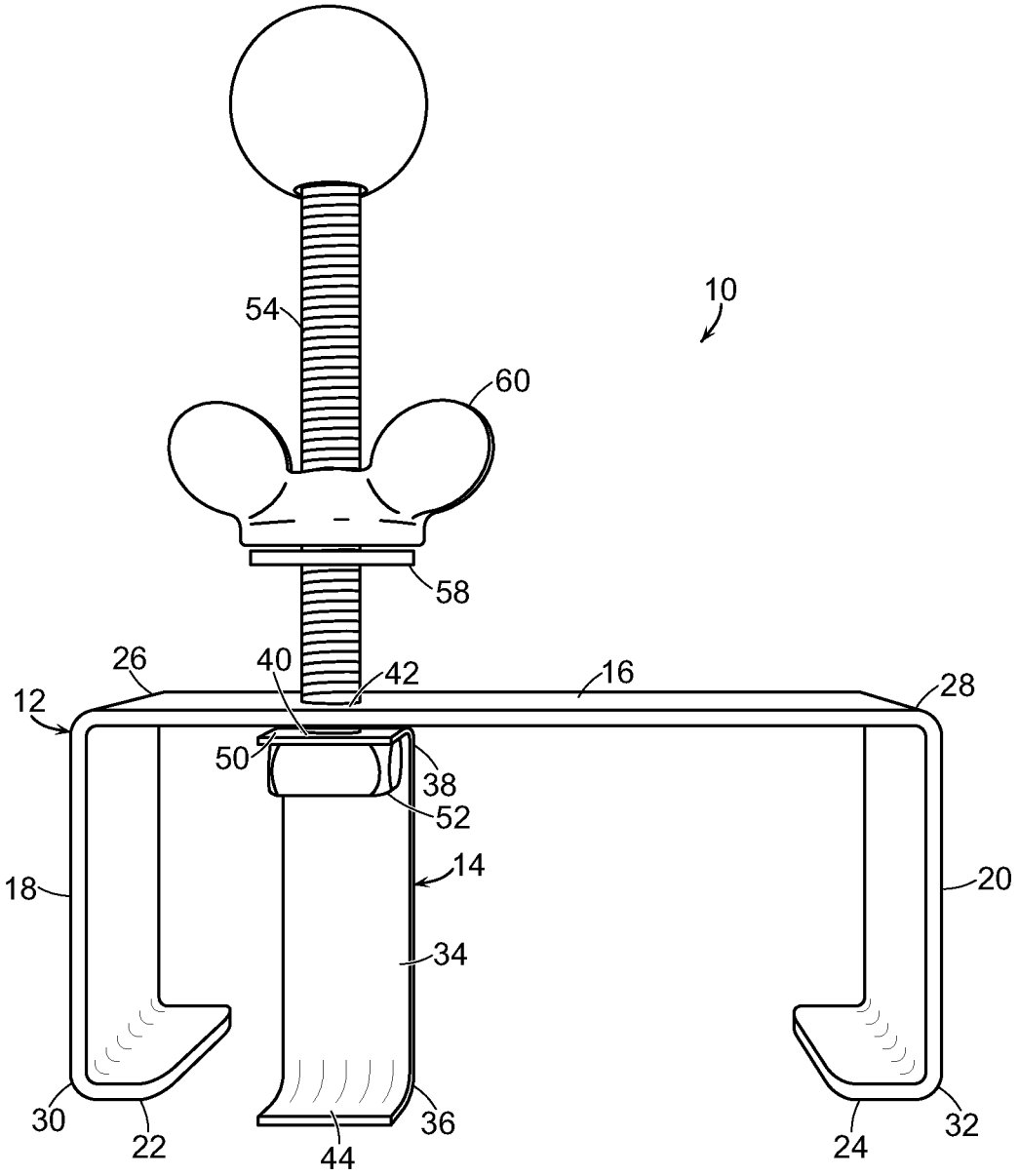
FIG. 1 is a perspective view of the portable door lock of the present invention prior to installation.
Figure 2:
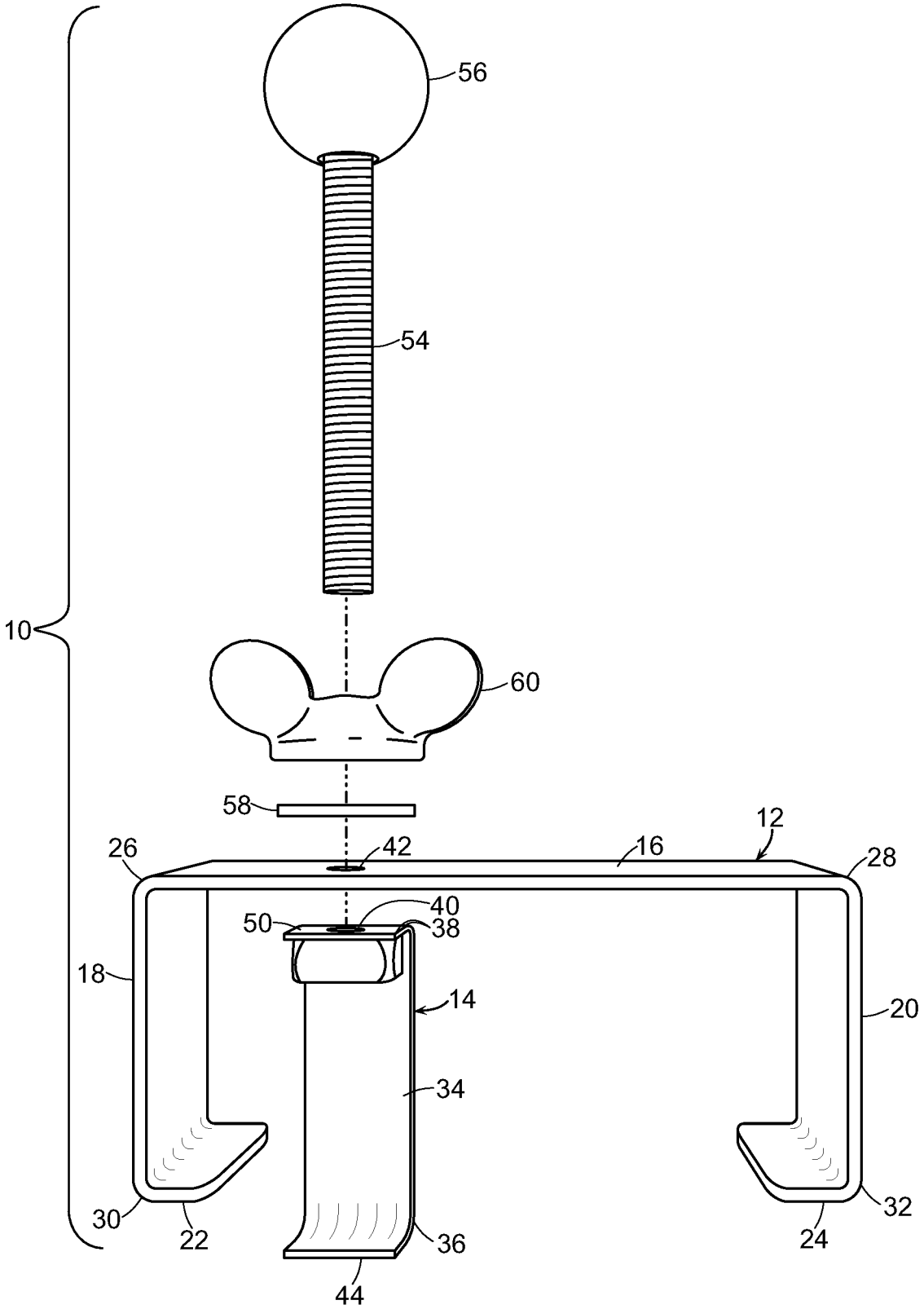
FIG. 2 is an exploded view of the portable door lock of the present invention as shown in FIG. 1.

As shown in FIGS. 1 and 2, the portable door lock 10 of the present invention is formed of a first U-shaped member 12 and a second U-shaped member 14. The members 12 and 14 are formed of flat strips of metal, such as steel, having a thickness to provide strength once installed. The first member 12 is bent to form a central portion 16 with spaced opposing legs 18 and 20. The opposing legs 18 and 20 extend transversely from the central portion 16 at opposite ends thereof, and, the opposing legs 18 and 20 terminate at feet 22 and 24 respectively, extending transversely from each leg toward the foot of the opposing leg. The member 12 is preferably formed of a strip at steel, bent to have the rectilinear U-shape shown in the drawings and to have curved or rounded corners 26 and 28 bent to join legs 18 and 20, respectively. Similarly, legs 18 and 20 have curved or rounded corners 30 and 32 joining leg 16 with foot 22 and leg 20 with foot 24, respectively.

The member 14 is bent to form a rectilinear U-shape with a connecting central portion 34 extending between opposing ends 36 and 38. End 38 forms a flange having a hole 40 therethrough for alignment with hole 42 in the central portion 16 of member 12. End 36 has a locking tab 44 extending transversely therefrom for engaging a recess 46 in a latch, plate 48 as shown FIGS. 3 and 4. The end 38 opposing end 36 is bent to form a flange 50 and has a locking nut 52 secured thereto for receiving a threaded adjustment shaft 54 terminating at a ball-shaped handle 56. A felt gasket 58 is disposed above hole 42. A threaded wing nut 60 threadedly engages shaft 54 to abut central portion 16 of member 12 such that rotation of nut 60 moves member 12 relative to member 14.

Figure 3:
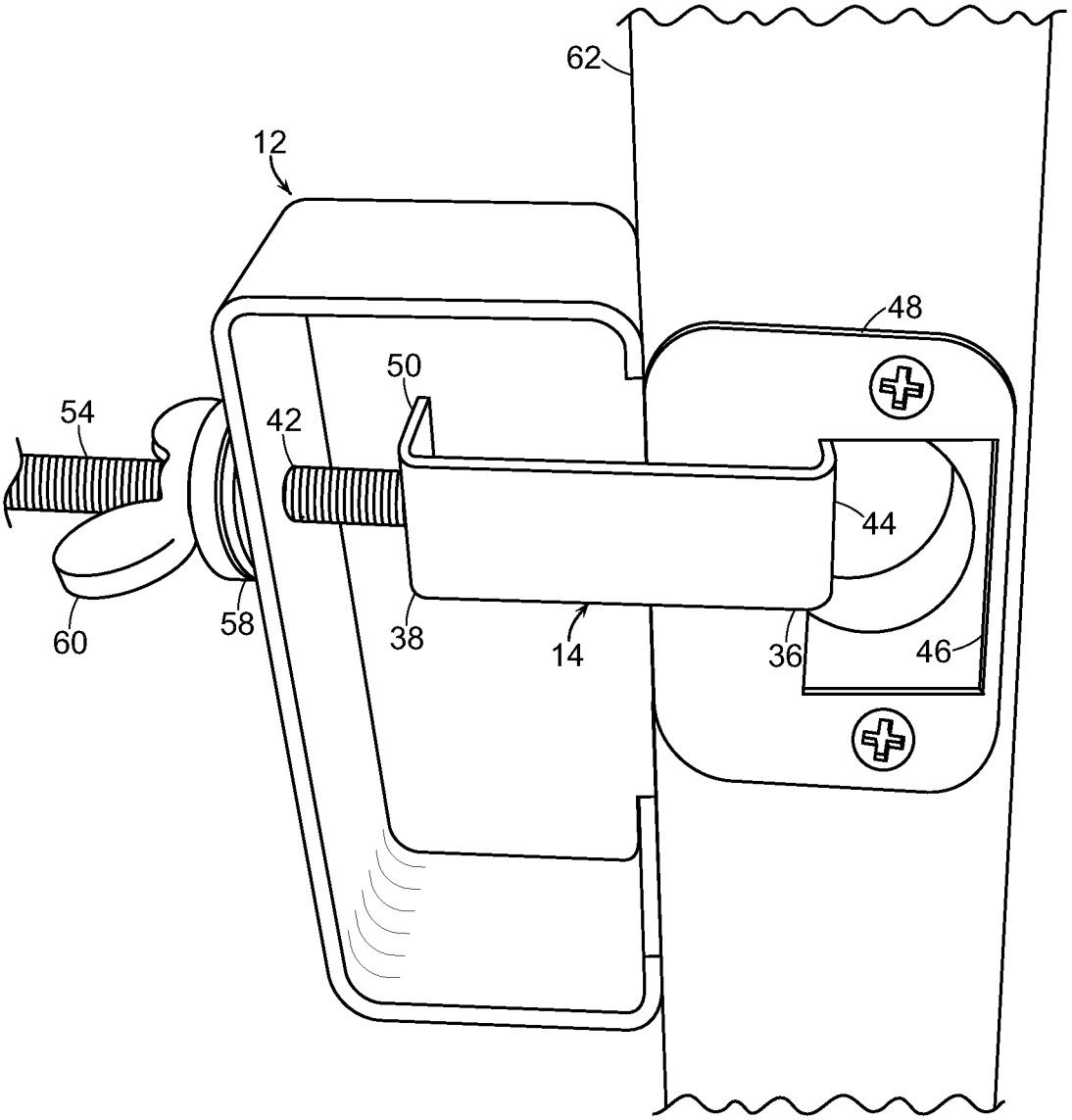
FIG. 3 is a broken side view of the portable door lock of the present invention showing installation of the portable door lock in a door jamb.
Figure 4:
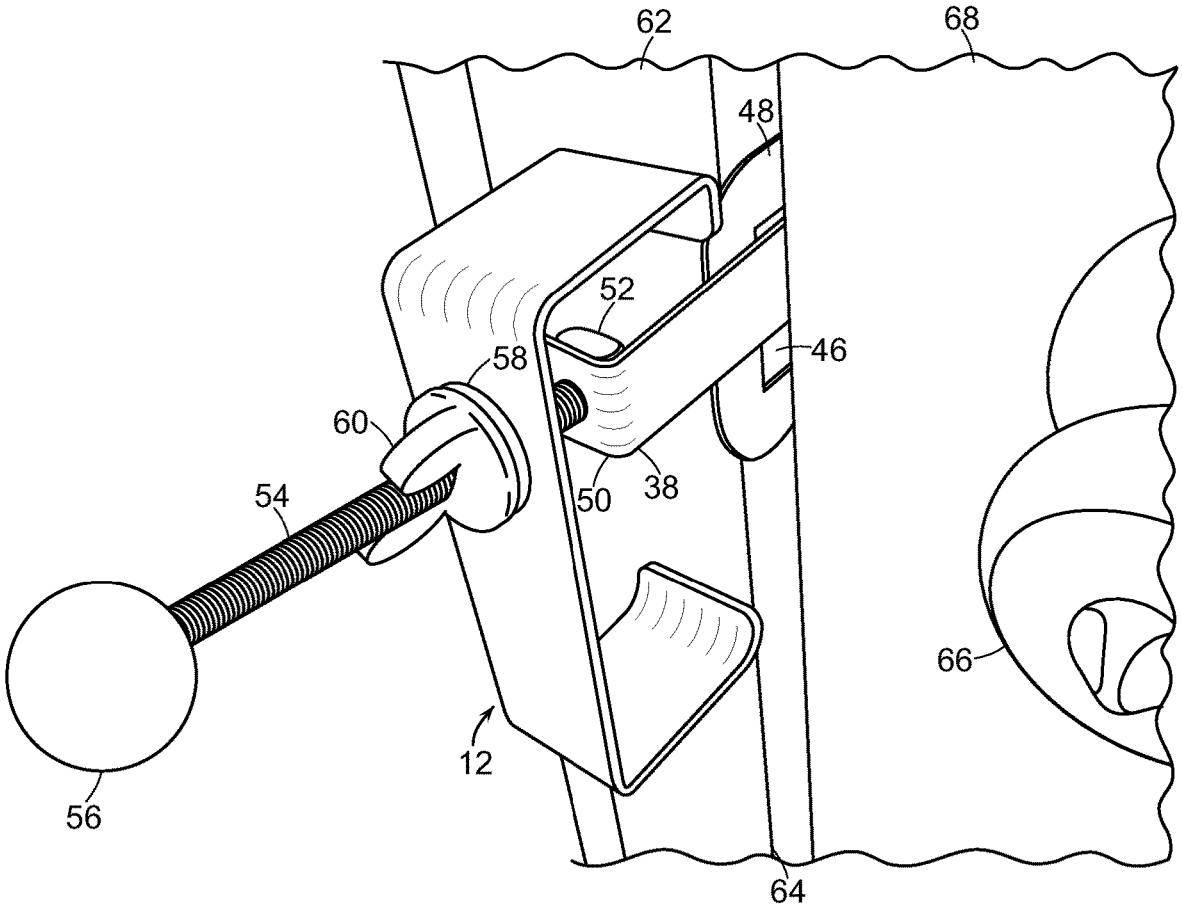
FIG. 4 is a broken perspective view of a door and door jamb with the portable door lock of the present invention affixed thereto.
Figure 5:
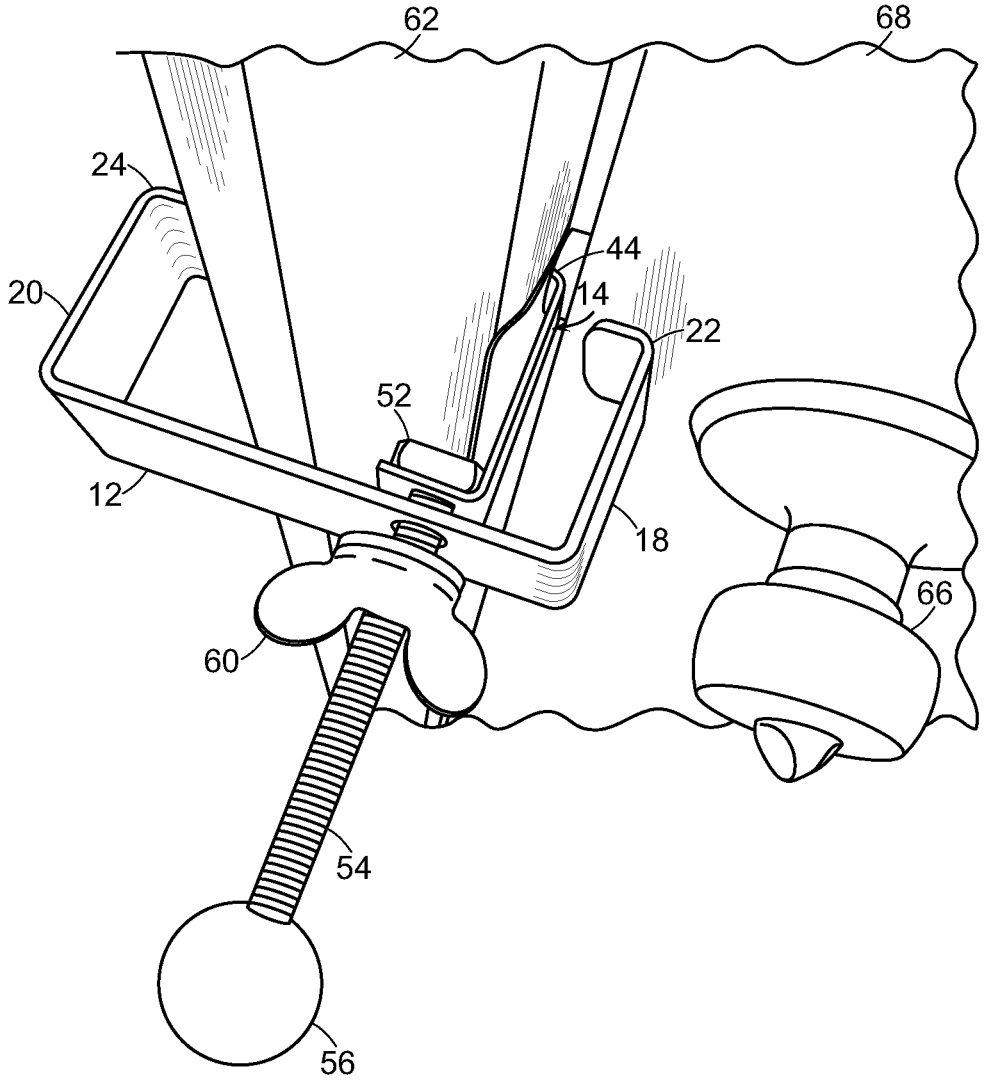
FIG. 5 shows use f the portable door lock of the present invention in its security position.

In use, an individual carries the portable door lock 10 in a compact condition to easily fit into a purse or briefcase. In the compact condition, member 12 is rotated relative to member 14 so as to align legs 18 and 20 with the longitudinal axis of member 14. Once the individual is in a room or other area to be secured, the member 12 is positioned as shown in FIGS. 3 and 4 such that the feet 22 and 24 engage the frame structure 62 of a doorway 64 adjacent a doorknob or handle 66 which is normally aligned with latch plate 48. The portable door lock is then moved toward the latch plate until locking tab 44 is aligned with recess 46 in the latch plate such that, the locking tab 44 can be inserted in the recess 46 in the latch plate. Once the locking tab is properly inserted, the nut 60 is rotated on the shaft 54 to cause members 12 and 14 to clamp the portable door lock 10 in place as shown in FIG. 5. The feet 22 and 24, thus, engage the door 68 and the door jamb or frame 62 and the member 14 is pulled tightly against the latch plate. Accordingly, the door cannot be opened due to abutment of the door with the feet and legs of member 12.

The following are exemplary specifications for the portable door lock 10: the member 12 can be made of 11 gauge flat steel and have a width of 0.75 inch; the member 14 can be made of 17 gauge flat steel and have a width of 0.75 inch; the length of connecting portion 34 can be 2.0 inches; the length of locking tab 44 can be 0.5 inch; the length of flange 38 can be 0.5 inch; the shaft 54 can have a diameter of 0.375 inch and a length of 4.0626 inch; and the felt washer 58, the nut 52 and the nut 60 are sized to receive the shaft 54. The legs 18 and 20 can have a length of 1.75 inches; the length of the central portion 16 can be 4.0625 inches; the length of each foot 22 can be 0.5 inch; the ball-shaped handle 56 can have a diameter of 1.0 inch to be easily grasped and can be made of plastic. The above example dimensions are provided to indicate the small size of the compact portable door lock.

In operation, once the portable door lock 10 is positioned in the door jamb with the locking tab engaging the latch plate, the member 12 will initially be in a vertical position as shown in FIG. 4 such that the member 12 will not obstruct movement of the door 68. Accordingly, in the position shown in FIG. 4, an individual can use the door normally. When it is desired to secure the door, the member 14 is turned 90° so as to be essentially horizontal as shown in FIG. 5. Accordingly, the feet on the legs of member 12 will engage the structure of the door and the door jamb simultaneously to prevent opening of the door. Egress from the secured area quickly can be achieved by turning the member 12 back to the position shown in FIG. 4 in case of an emergency. The rounded corners of the bends prevent damage to the structure of the door or the doorway.

Inasmuch the present invention is subject to many variations, modifications and changes in detail, it is intended that all subject matter discussed above or shown in the accompanying drawings be interpreted as illustrative only and not be taken in a limiting sense.

What is claimed is:

1. A portable door lock for use with a door hingedly mounted in a doorway formed of a door jamb with a locking recess therein, said portable door lock comprising:

a first member formed of a flat strip of metal to have a rectilinear U-shape with a central portion and spaced opposing legs, each of said opposing legs extending transversely from said central portion and having a foot extending transversely only in one direction from each leg toward the foot of the other opposing leg, said opposing legs each having a substantially equal length, said central portion having a length greater than the combined lengths of said opposing legs and said central portion having a hole therethrough at a position between said opposing legs;

a second member formed of a flat strip of metal to have a rectilinear U-shape with a connecting portion and opposing first and second ends, a locking tab extending transversely from said first end of said connecting portion for engaging the locking recess and a threaded adjustment shaft disposed at said second end and extending through said hole in said central portion of said first member; and a threaded nut threadedly engaging said threaded adjustment shaft of said second member and abutting said central portion of first member such that rotation of said threaded nut moves said first member relative to said second member with said locking tab engaging the locking recess to cause said feet of said opposing legs to engage structure of the door and the door jamb simultaneously.

2. A portable door lock as recited in claim 1 wherein said first member can be rotated from a first position where said first member is ubstantially vertical to a second position where said first member is substantially horizontal to position the opposing legs to engage structure of the door and the door jamb simultaneously.

3. A portable door lock as recited in claim 2 wherein said threaded nut is a wing nut and rotation thereof allows moving said first member between the horizontal and vertical positions.

4. A portable door lock as recited in claim 3 wherein said ember is formed of a flat strip of metal having a first gauge, said second member is formed of a flat strip metal having a second gauge and said first gauge less than said second gauge.

5. A portable door lock as recited in claim 4 wherein said threaded adjustment shaft extends through a hole in said second end of said second member and a felt washers disposed between said threaded wing nut and said central portion of said first member.

* * * * *